US005536922A

United States Patent [19]

Cheng

[11] Patent Number: 5,536,922

[45] Date of Patent: Jul. 16, 1996

[54] SECURITY ELECTRIC CASH DRAWER

[75] Inventor: Tsung-Kan Cheng, Taipei, Taiwan

[73] Assignee: Mustek Corporation, Taipei, Taiwan

[21] Appl. No.: 381,643

[22] Filed: Jan. 31, 1995

[51] Int. Cl.[6] ..... G07G 1/00

[52] U.S. Cl. ..... 235/7 R

[58] Field of Search ..... 235/7 R, 10, 1 R; 109/58, 78, 79

[56] References Cited

U.S. PATENT DOCUMENTS

| | | | |
|---|---|---|---|
| 4,786,785 | 11/1988 | Felt | 235/7 R |
| 4,804,824 | 2/1989 | Saguchi | 235/7 R |
| 5,440,107 | 8/1995 | Phillips | 235/10 |

*Primary Examiner*—Patrick J. Stanzione

*Attorney, Agent, or Firm*—Knobbe, Martens, Olson & Bear

[57] ABSTRACT

A security electric cash drawer includes a shell having two inner lateral walls, a front opening, a bottom opening and a front securing plate, a bottom plate having a front bent end and inserted into the shell to be held secured to the shell for covering the bottom opening, a pair of tracks respectively mounted on the two inner lateral walls, and a drawer slidable along the pair of tracks and inserted into the shell from the front opening.

Further, the security electric cash drawer includes a securing piece inserted from an inside of the shell for fixing the bottom plate in place in order to avoid the cash drawer from being externally disassembled. This invention also provides a tray having a plurality of detachable clips for conveniently managing kinds of cashes.

12 Claims, 7 Drawing Sheets

SECURITY ELECTRIC CASH DRAWER

FIELD OF THE INVENTION

This invention relates to a security electric cash drawer, more particularly to a security electric cash drawer having a securing piece being capable of securing a bottom plate from an inside of the shell, and more specifically to a security electric cash drawer providing detachable clips for effectively accommodating the cash storage.

BACKGROUND OF THE INVENTION

In our daily life related places, such as a drug store, a supermarket and so on, we can see that security electric cash drawers are widely and effectively applied for collecting kinds of cashes and issuing invoices. In addition, a security electric cash drawer is served as a saving box when people are off duty, and with this purpose, security is the most concerned thing. However, there are still shortcomings in currently used security electric cash drawers. For example, external fixing means, such as screws or nuts for securing thereby the bottom plate to cover the bottom opening of a security electric cash drawer, are easily disassembled to open the drawer. Further, currently used security electric cash drawers are in lack of detachable clips with a function for effectively managing kinds of currencies.

SUMMARY OF THE INVENTION

An object of the present invention is to provide a security electric cash drawer with a pair of staples being capable of securing the bottom plate from an inside of the shell for avoiding theft.

Another object of the present invention is to provide a security electric cash drawer having a plurality of detachable clips for effectively managing kinds of cashes.

In accordance with the present invention, a security electric cash drawer includes a shell having two inner lateral walls, a front opening and a bottom opening and a front securing plate, a bottom plate inserted into the shell to be held secured to the shell for covering the bottom opening, a pair of tracks respectively mounted on the two inner lateral walls, and a drawer slidable along the pair of tracks and inserted into the shell from the front opening.

In accordance with the present invention, the front securing plate further includes an upright stopper having four holes. The front bent end of the bottom plate includes four holes respectively corresponding to the four holes of the front securing plate. The security electric cash drawer further comprises a pair of securing pieces for securing the bottom plate in place through the corresponding holes and from an inside of the shell.

In accordance with the present invention, the pair of securing pieces are staples. Each of the staple is a metal wire having two bent ends.

In accordance with the present invention, a security electric cash drawer further includes a tray for storing cash. The tray comprises a rear wall, a plurality of clips for securing an object, and a mounting protruding inwardly from the rear wall and having a plurality of through holes for retaining the plurality of clips.

Each of the plurality of clips also includes a first joint piece having a first end, a fourth opposite end, a first cavity and a first lateral member protruding into the first cavity, a second joint piece having a second end, a third opposite end, a second cavity and a second lateral member protruding into the second cavity, an elastic element connected between the first and the second lateral members for alternatively securing the first joint piece in an open and a close positions, and a pair of barbs respectively perpendicularly downwardly protruding from two sides of the third end for being correspondingly detachably retained in the mounting.

In accordance with the present invention, the first end has a middle indentation and two shoulders, and the second end has two lateral indentations for correspondingly respectively fitting therein the two shoulders of the first end and two corresponding protuberances respectively fitted in the middle indentation of the first end.

In accordance with the present invention, the fourth end is a slope for securing the object.

In accordance with the present invention, the elastic element connected between the first and the second lateral members is a spring.

The present invention may best be understood through the following description with reference to the accompanying drawings, in which:

DETAILED DESCRIPTION OF THE PREFERRED EMBODIMENT

Figure 1:
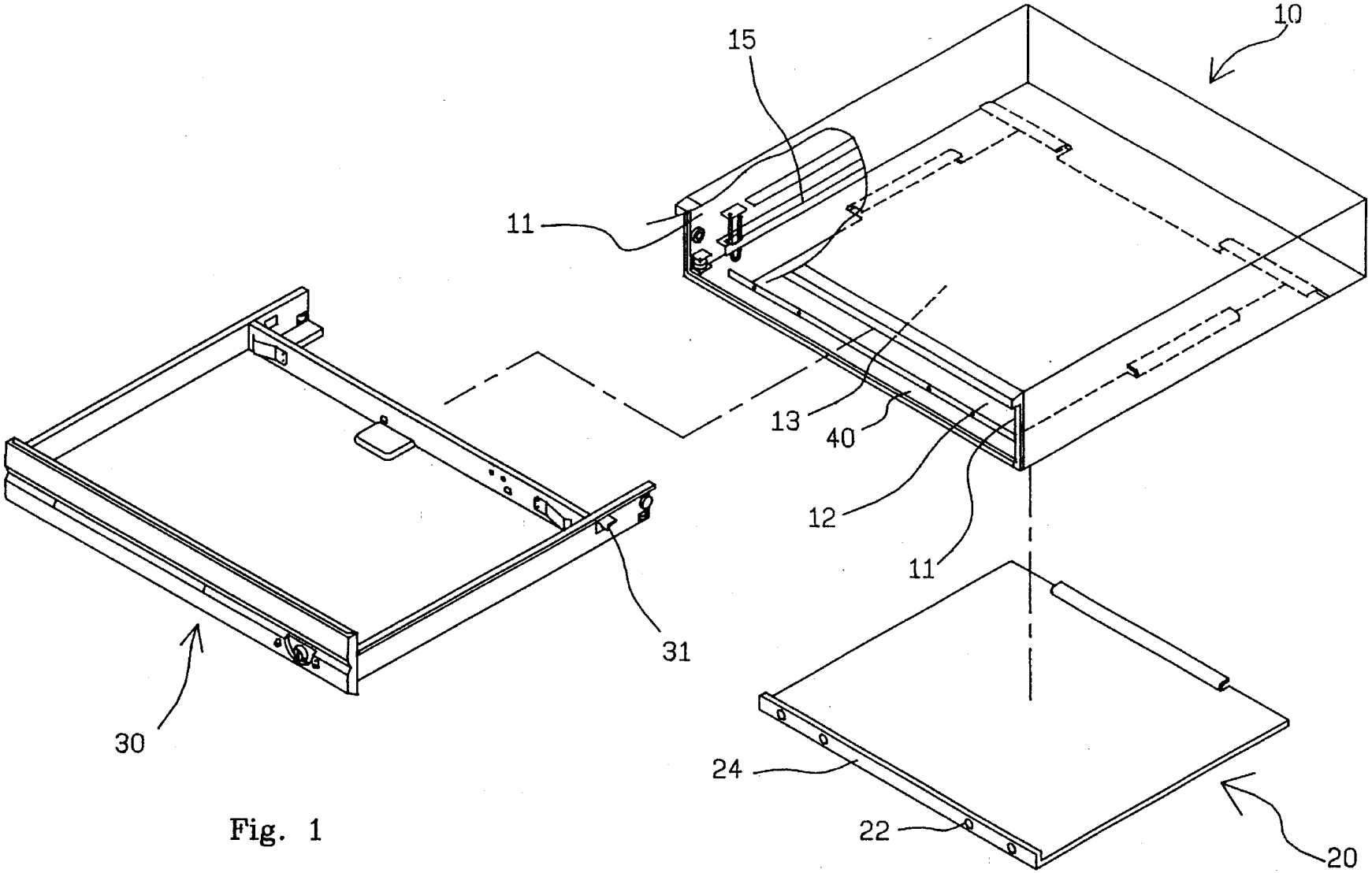
FIG. 1 is a schematic view showing disassembled parts of a security electric cash drawer of the present invention.

Referring to FIG. 1, a preferred embodiment of the present cash register includes a shell 10 having two inner lateral walls 11, a front opening 12 and a bottom opening 13 and a front securing plate 40, a bottom plate 20 inserted into the shell 10 to be held secured to the shell 10 for covering the bottom opening 13, a pair of tracks 15 respectively mounted on the two inner lateral walls 11, and a drawer 30 slidable along the pair of tracks 15 and inserted into the shell 10 from the front opening 12.

Figure 2A:
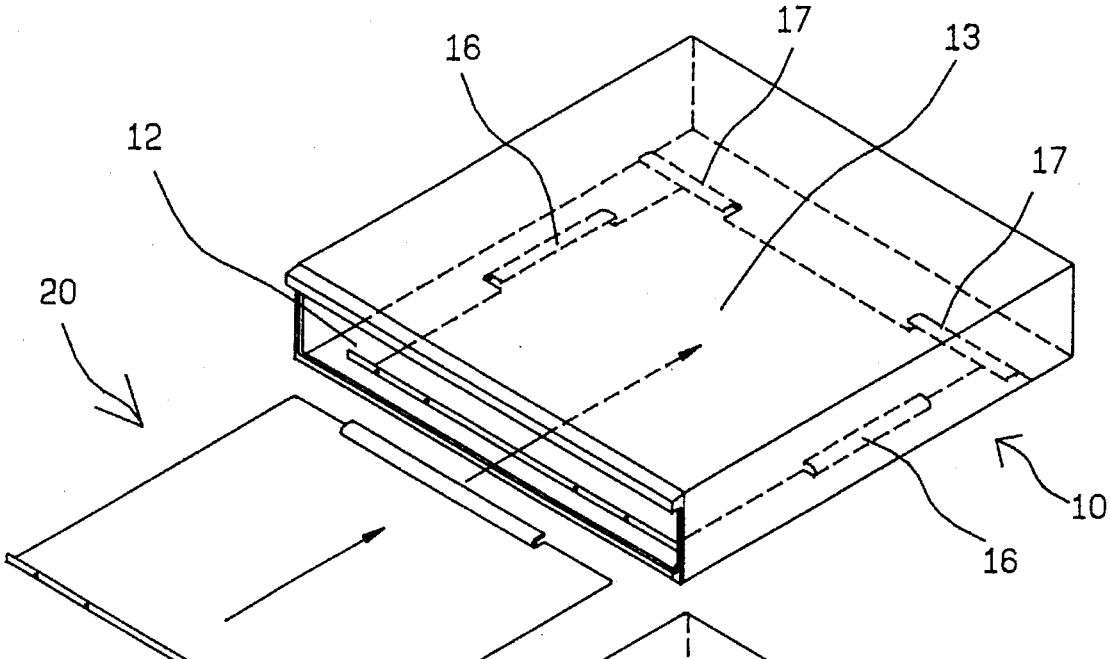
FIGS. 2A, 2B & 2C are exploded views schematically showing the assembling procedure of inserting the bottom plate into the shell of a preferred embodiment of the present invention.
Figure 2B:
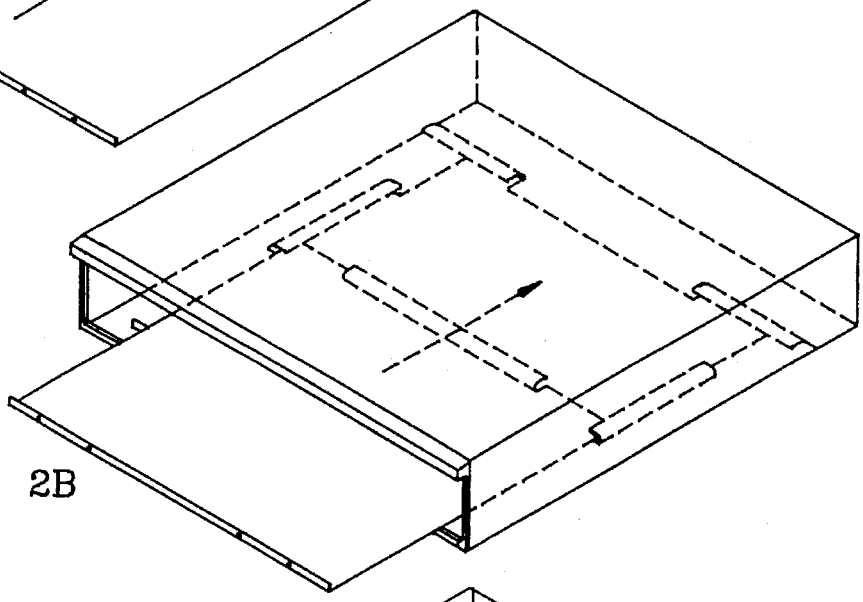
Figure 2C:
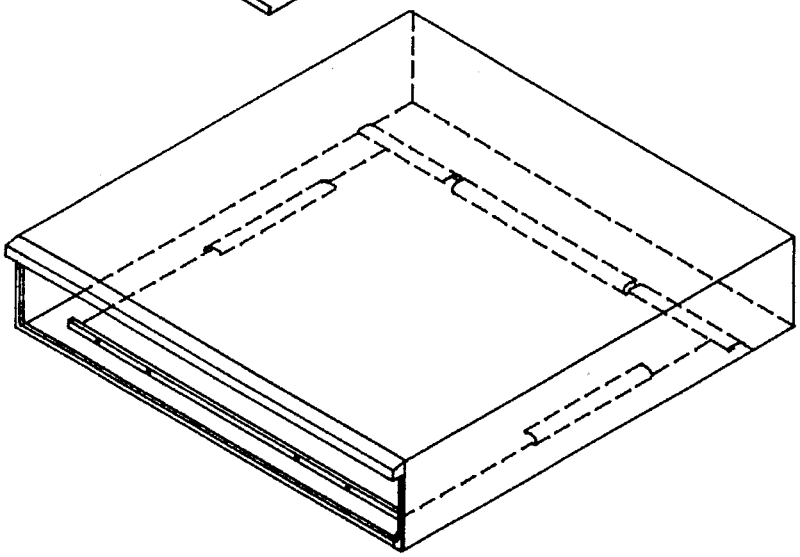
Figure 3:
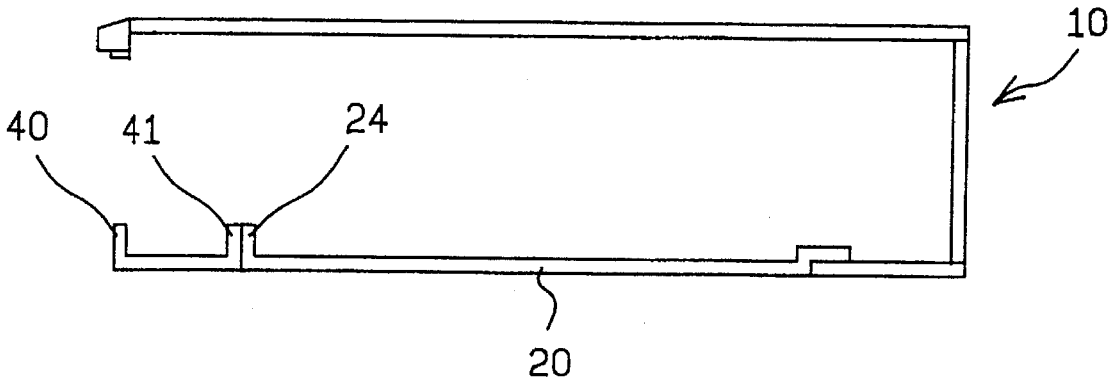
FIG. 3 is a side view showing a relevant location after inserting the bottom plate into the shell.
Figure 4:
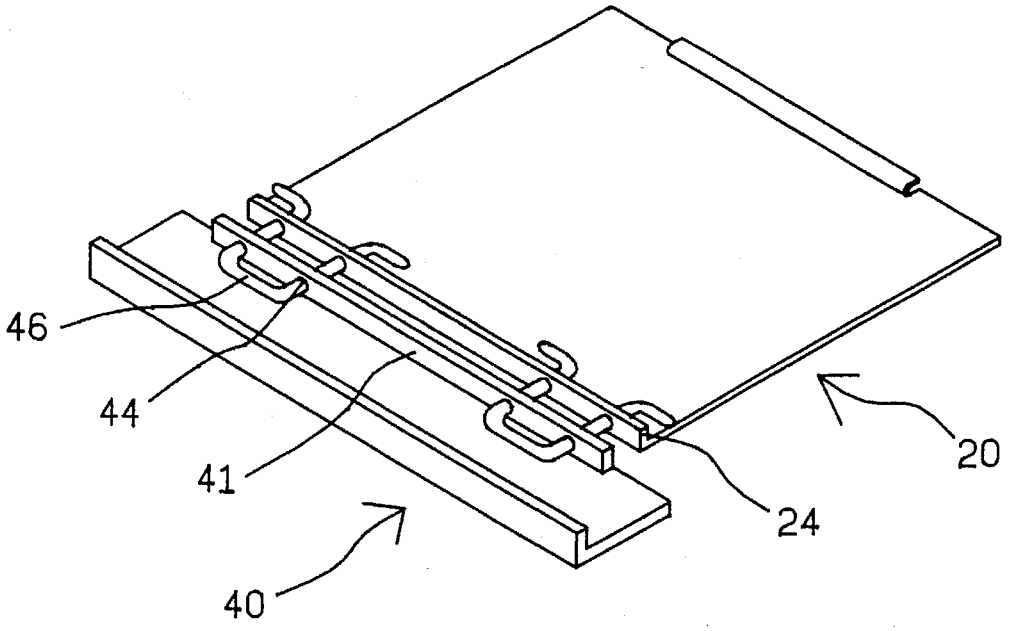
FIG. 4 is a schematic view showing a preferred embodiment of securing the bottom plate to the shell with staples according to the present invention.

Referring to FIGS. 2A, 2B & 2C, the shell 10 further includes two bottom lateral strips 16 and two bottom rear strips 17 respectively defining therebetween the bottom opening 13 so as to form a space for inserting the bottom plate 20. The front securing plate 40 includes an upright stopper 41 having two pairs of holes 44; and, as shown in FIGS. 3 & 4, the bottom plate 20 has a front bent end 24 also having two pairs of holes 22 respectively corresponding to the four holes 44 of the front securing plate 40. After the bottom plate 20 is inserted in place, one can respectively use two staples 46 to pass through the respectively corresponding pairs of holes 24 and 44 to secure the bottom plate 20. This leaves no external fixing means, such as screws or nuts, and can thus definitely avoid being eternally disassembled.

Figure 5:
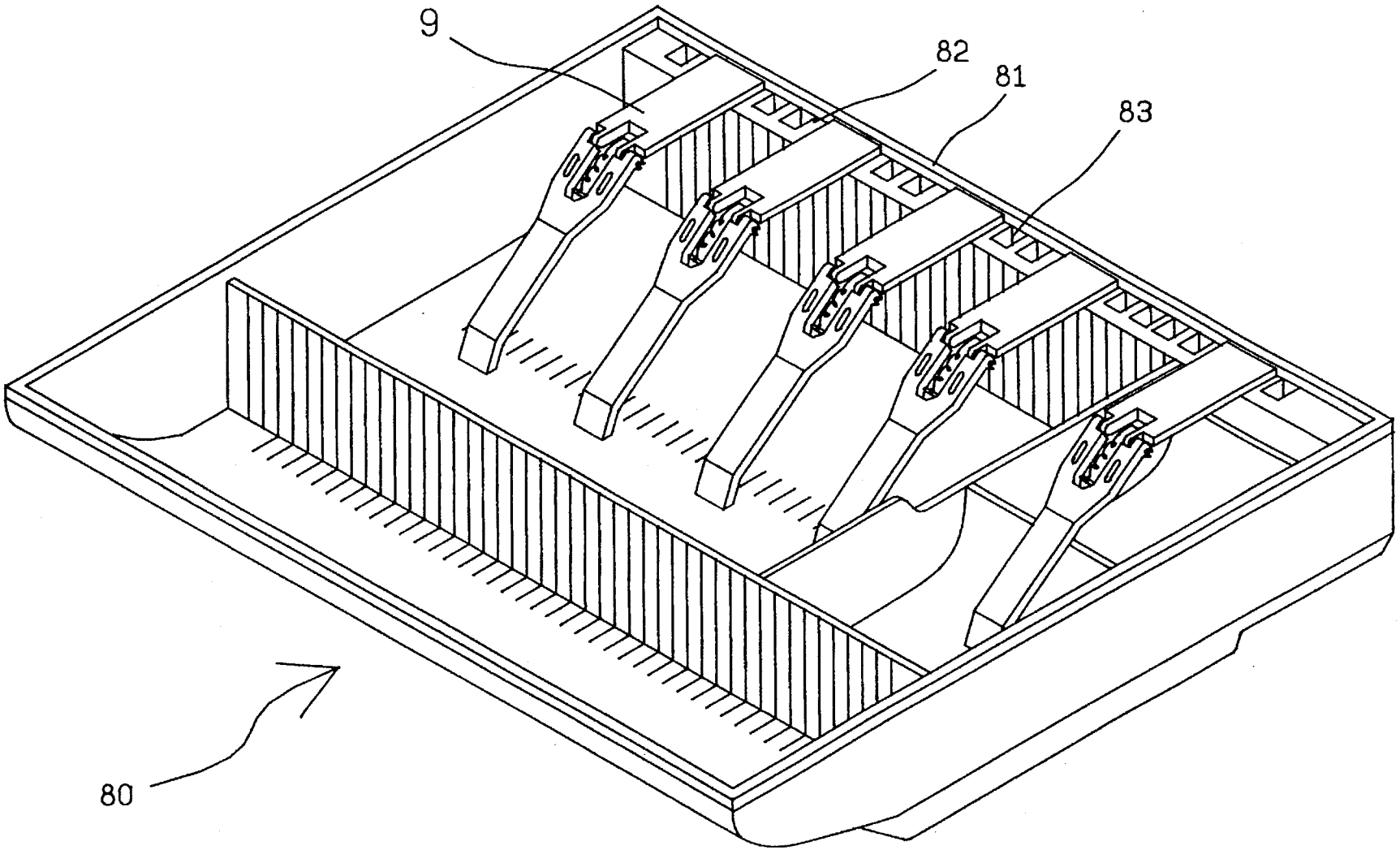
FIG. 5 is a schematic view showing a preferred embodiment of the tray of the present invention.

Referring to FIG. 5, the present invention further includes a tray 80 for storing cash. The tray 80 comprises a rear wall 81, a plurality of clips 9 for securing an object, and a mounting 82 protruding inwardly from the rear wall 81 and having a plurality of through holes 83 for respectively retaining the plurality of clips 9.

Figure 6:
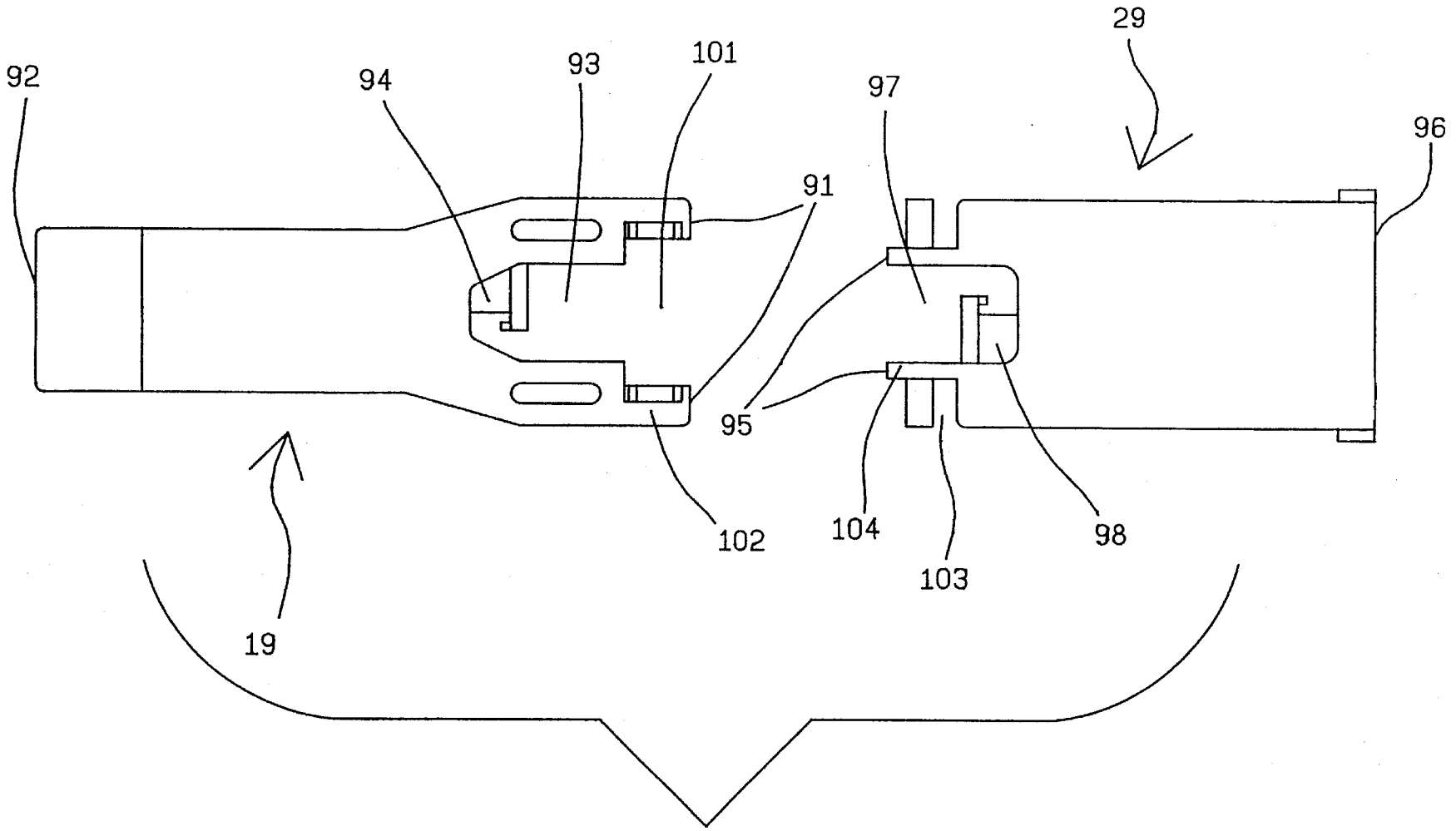
FIG. 6 is a top view showing a disassembled clip of the present invention.
Figure 7:
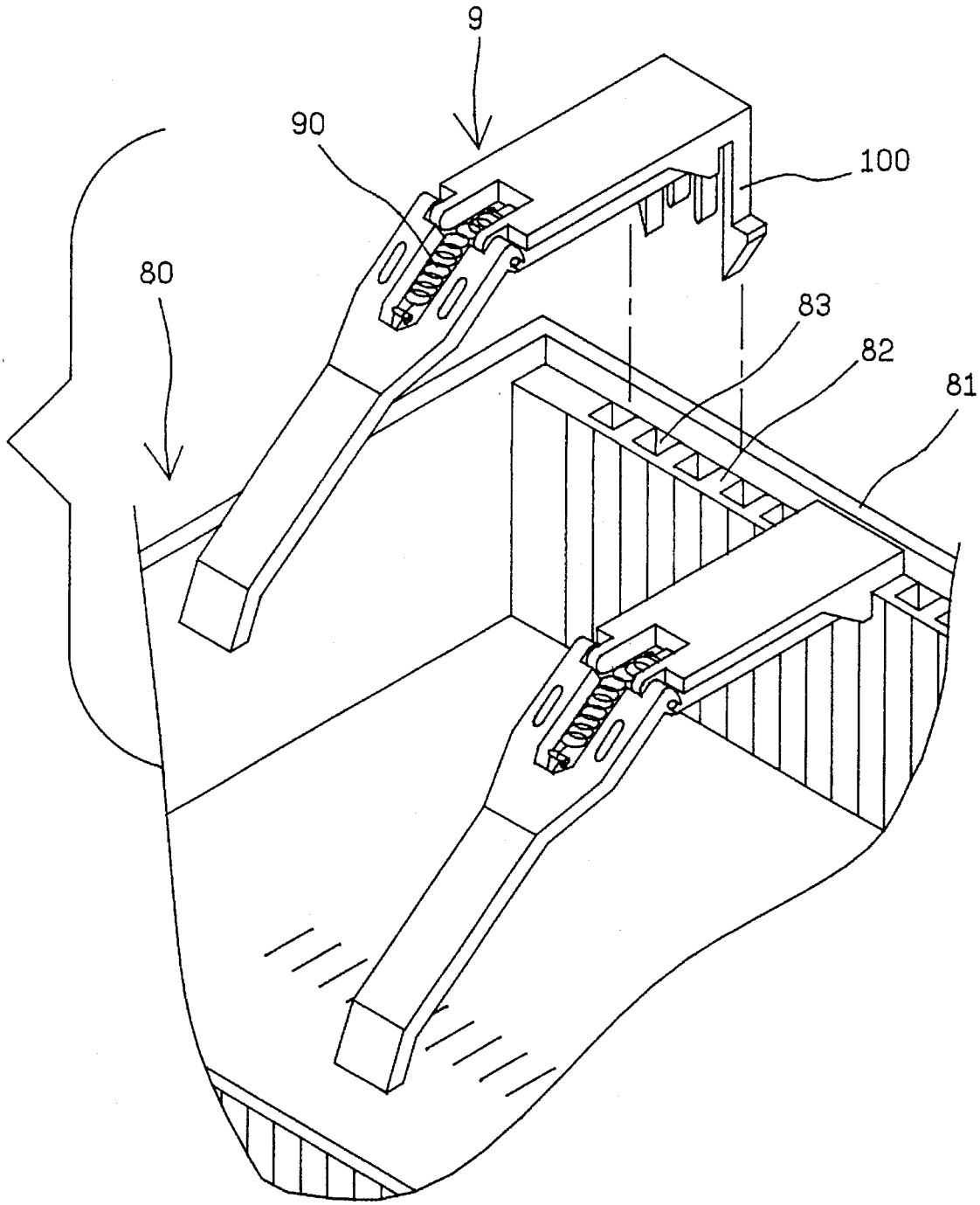
FIG. 7 is a schematic view showing a preferred embodiment of a clip of the present invention in a first position.
Figure 8:
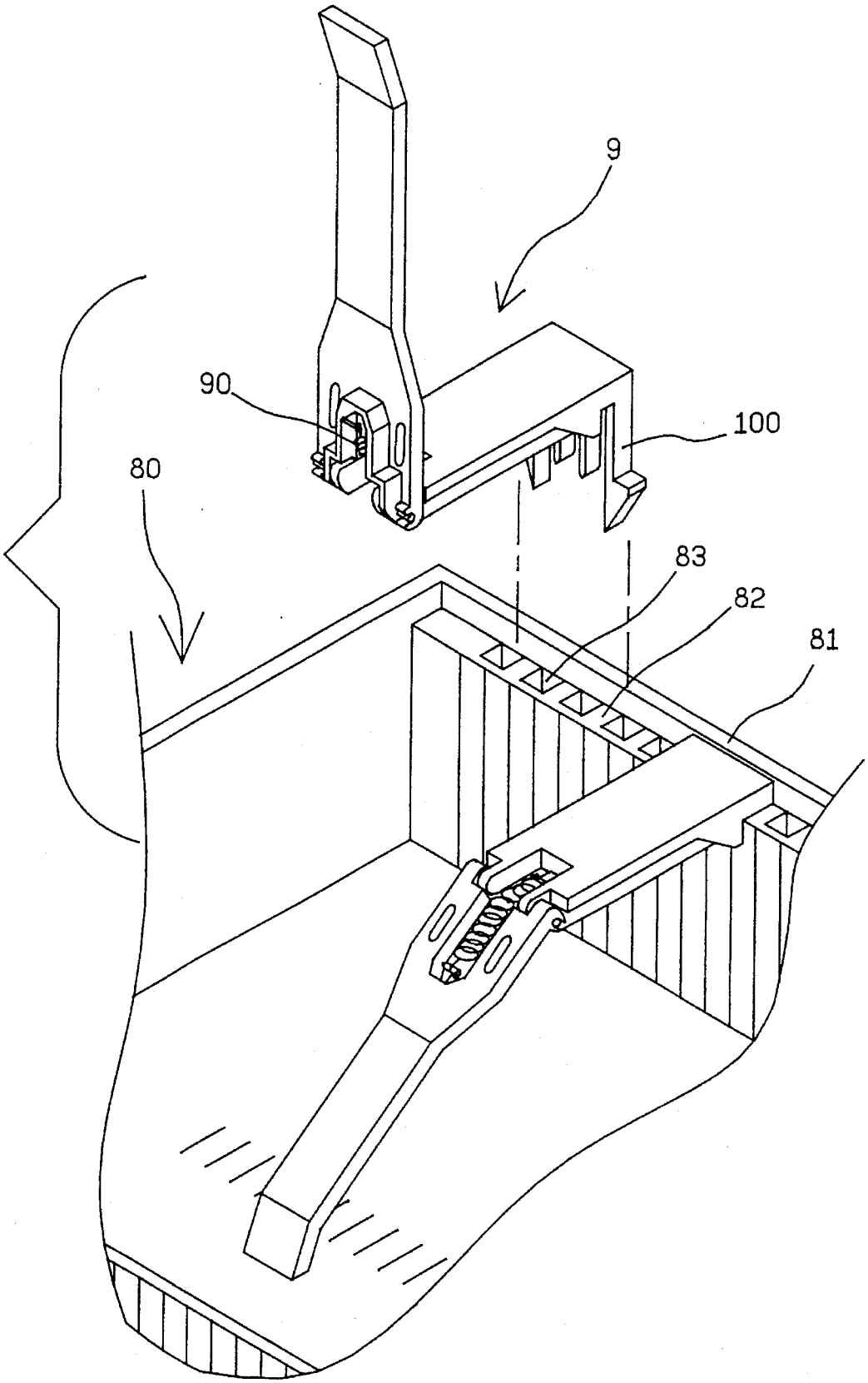
FIG. 8 is a schematic view showing a preferred embodiment of a clip of the present invention in a second position.

Referring to FIG. 6, each of the plurality of clips 9 includes a first joint piece 19 having a first end 91, a fourth opposite end 92, a first cavity 93 and a first lateral member 94 protruding into the first cavity 93, a second joint piece 29 having a second end 95, a third opposite end 96, a second cavity 97 and a second lateral member 98 protruding into said second cavity 97, a spring 90 shown in FIGS. 7 & 8 and connected between the first and the second lateral members 94 and 98 for alternatively securing the first joint piece 19 in an open and a close positions as respectively shown in FIGS. 7 and 8, and a pair of barbs 100 respectively perpendicularly downwardly protruding from two sides of the third opposite end 96 for being correspondingly detachably retained in the mounting 82. The first end 91 has a middle indentation 101 and two shoulders 102, and the second end 95 has two lateral indentations 103 for correspondingly respectively fitting therein the two shoulders 102 of the first end 91 and two corresponding protuberances 104 respectively fitted in the middle indentation 101 of the first end 91. Preferably, the fourth end 92 is a slope for securing the object.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A security electric cash drawer comprising:

a shell having two inner lateral walls, a front opening, a bottom opening and a front securing plate;

a bottom plate having a front bent end and inserted into said shell to be held secured to said shell for covering said bottom opening;

a pair of tracks respectively mounted on said two inner lateral walls; and a drawer slidable along said pair of tracks and inserted into said shell from said front opening.

2. A security electric cash drawer according to claim 1, wherein said front securing plate further comprises an upright stopper having four holes.

3. A security electric cash drawer according to claim 2, wherein said front bent end of said bottom plate comprises four holes corresponding to said four holes of said front securing plate.

4. A security electric cash drawer according to claim 3 further comprising a pair of securing pieces for securing said bottom plate in place through said corresponding holes and from an inside of said shell.

5. A security electric cash drawer according to claim 4, wherein said pair of securing pieces are staples.

6. A security electric cash drawer according to claim 5, wherein each of said staple is a metal wire having two bent ends.

7. A security electric cash drawer according to claim 1 further comprising a tray for storing cash.

8. A security electric cash drawer according to claim 7, wherein said tray further comprises:

a rear wall;

a plurality of clips for securing an object; and a mounting protruding inwardly from said rear wall and having a plurality of through holes for retaining said plurality of clips.

9. A security electric cash drawer according to claim 8, wherein each of said plurality of clips further comprises:

a first joint piece having a first end, a fourth opposite end, a first cavity and a first lateral member protruding into said first cavity;

a second joint piece having a second end, a third opposite end, a second cavity and a second lateral member protruding into said second cavity;

an elastic element connected between said first and said second lateral members for alternatively securing said first joint piece in an open and a close positions; and a pair of barbs respectively perpendicularly downwardly protruding from two sides of said third end for being correspondingly detachably retained in said mounting.

10. A security electric cash drawer according to claim 9, wherein said first end has a middle indentation and two shoulders, and said second end has two lateral indentations for correspondingly respectively fitting therein said two shoulders of said first end and two corresponding protuberances respectively fitted in said middle indentation of said first end.

11. A security electric cash drawer according to claim 9, wherein said fourth end is a slope for securing said object.

12. A security electric cash drawer according to claim 9, wherein said elastic element is a spring.

* * * * *